United States Patent [19]

Grant

[11] Patent Number: 4,506,828

[45] Date of Patent: Mar. 26, 1985

[54] REVERSIBLE DAMPER MEANS

[76] Inventor: Willie T. Grant, 400 S. Simms St., Lakewood, Colo. 80228

[21] Appl. No.: 504,886

[22] Filed: Jun. 16, 1983

[51] Int. Cl.[3] ..... F24F 13/14

[52] U.S. Cl. ..... 236/49; 98/40.25; 98/121.2; 137/601

[58] Field of Search ..... 236/49; 98/102, 107, 98/110, 121 A, 40 VT; 248/295.1, 297.2; 52/217; 137/601

[56] References Cited

U.S. PATENT DOCUMENTS

| | | | |
|---|---|---|---|
| 1,631,355 | 6/1927 | Baldwin | 248/295.1 X |
| 2,319,109 | 5/1943 | Bulloch | 248/295.1 X |
| 2,805,026 | 9/1957 | Sparrow | 236/9 A |
| 3,068,971 | 12/1962 | Ringler | 49/82 X |
| 3,120,940 | 2/1964 | Del Faro et al. | 248/295.1 X |

*Primary Examiner*—William E. Tapolcai

[57] ABSTRACT

Automatic damper means having a multiplicity of damper blades rotatably mounted in housing means to control and regulate the flow of a heating/cooling medium into individual rooms or zones served by a central heating/cooling appliance. The damper blades are opened and closed by a reversible motor connecting to a driver blade, all blades being interconnected by linkage means. The motor and a fuel control device on the heating/cooling appliance are energized by thermostatic means.

12 Claims, 8 Drawing Figures

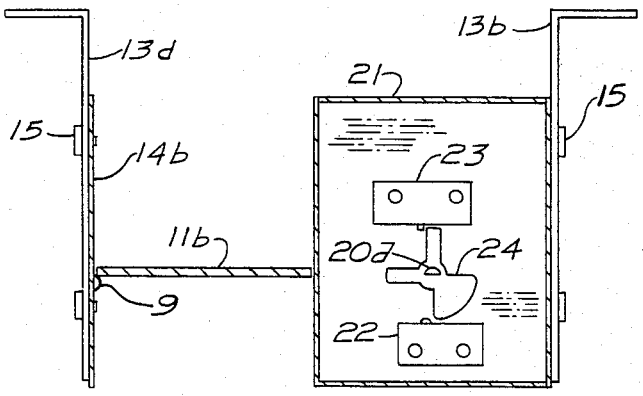
FIG. 5
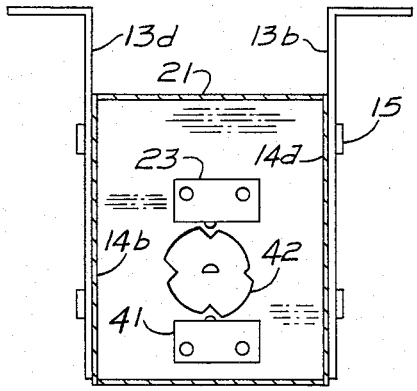
FIG. 6
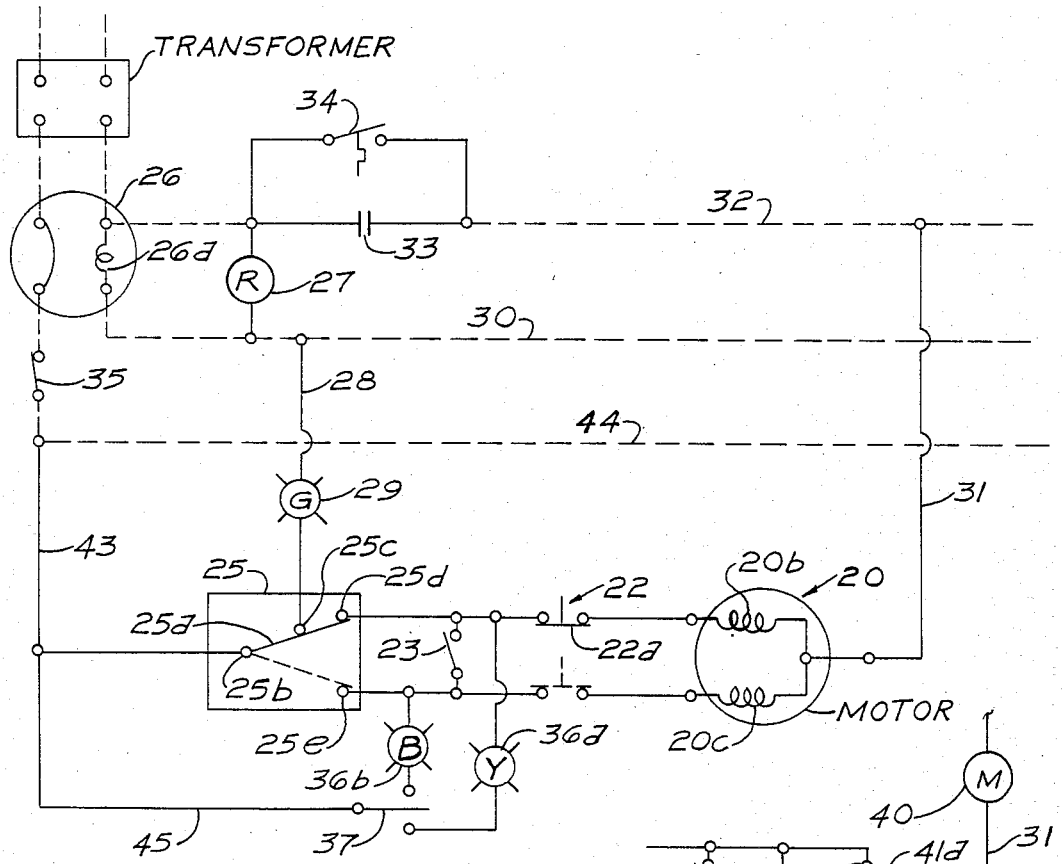
FIG. 7
FIG. 8

REVERSIBLE DAMPER MEANS

The present invention sets forth improvements in the operation of the automatic damper means of application Ser. No. 385,765.

In the referenced application the motor means rotating the damper blades is comprised of a unidirectional motor having its shaft attached to one of the damper blades. Because the motor rotates in only one direction, gear means are utilized to provide rotation of the multiple damper blades in a 360 degree arc through four equal increments of arc.

Incorporating reversing motor means in the present invention permits a linkage mechanism to replace the aforesaid gears thereby allowing an incremental rotation of 90 degrees in a forward direction, opening the blades and a subsequent rotation of 90 degrees in the opposite direction, closing the damper blades. Thus, the reversing motor means operates the multiple damper blades effectively when said damper blades are connected by a simpler linkage mechanism replacing the gear means of previously stated reference.

The damper means being placed in a wall, ceiling, or floor recess housing a duct boot are energized and controlled by a thermostatic means regulating the temperature in a room or zone. When the room environment requires an increase in the temperature, said thermostatic means activates a fuel control device on a heating-/cooling appliance influencing the applicance to enter a combustion cycle. Simultaneously, one of two windings of the reversing motor means is energized to rotate the damper blades to an open position in preparation for transmitting a heating/cooling medium into the room. When aforesaid environment has reached the desired temperature, said thermostatic means deenergizes the fuel control device and energizes the second motor winding to rotate the damper blades to the closed position.

It is a primary objective of the present invention to provide automatic damper means having a multiplicity of blades with simple operating means and few movable components.

Another objective is to provide fully operable damper means having an adjustable housing for mounting in recesses enclosing duct boots.

These and other objects and advantages of the present invention will become apparent after considering the following detailed specification and accompanying drawings which cover a preferred embodiment, wherein:

FIG. 5 is a cross-sectional view taken along line 5—5 of FIG. 1.

FIG. 6 is a cross-section similar to FIG. 5 showing the switch means and switch operator for a single blade damper means.

FIG. 7 shows the schematic diagram of the electrical circuitry for energizing and controlling the present invention.

FIG. 8 is a partial schematic showing the revised circuitry required for the single blade damper means.

Figure 1:
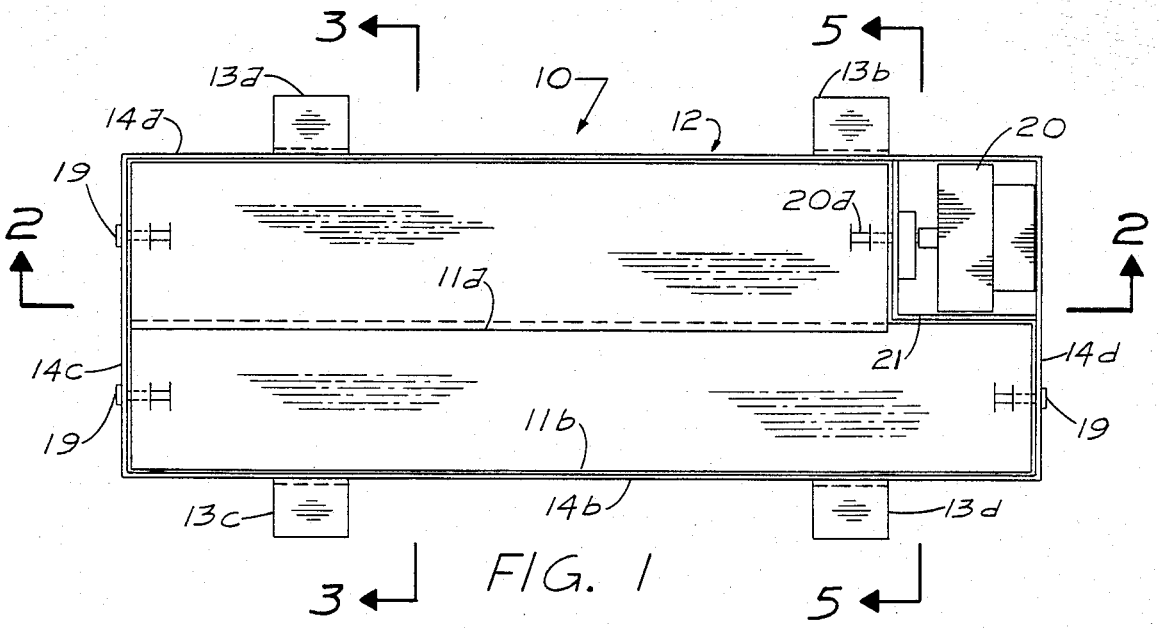
FIG. 1 is a plan view of the automatic multiblade damper device constructed according to the present invention.

Giving attention to the drawings more specifically, FIG. 1 shows automatic damper means 10 having two damper blades 11*a* and 11*b* representing the multiplicity of blades that can be rotatably mounted in adjustable damper housing 12. As shown in the several views, housing 12 has four sliding support bars 13*a*–13*d* attaching to panels 14*a* and 14*b* by screw means 15. Each support bar is formed with a slot 16 along a vertical axis (FIG. 2) providing for adjustment of damper housing 12 within the recess 17 of FIG. 3, within which duct boot 18 is mounted. Said housing adjustment permits the use of registers of non-standard thickness to be placed over said damper housing. Screw means 15 pass through slot 16 tightening into threaded holes in side panels to secure said supports 13*a*–13*d* to damper housing 12.

Figure 2:
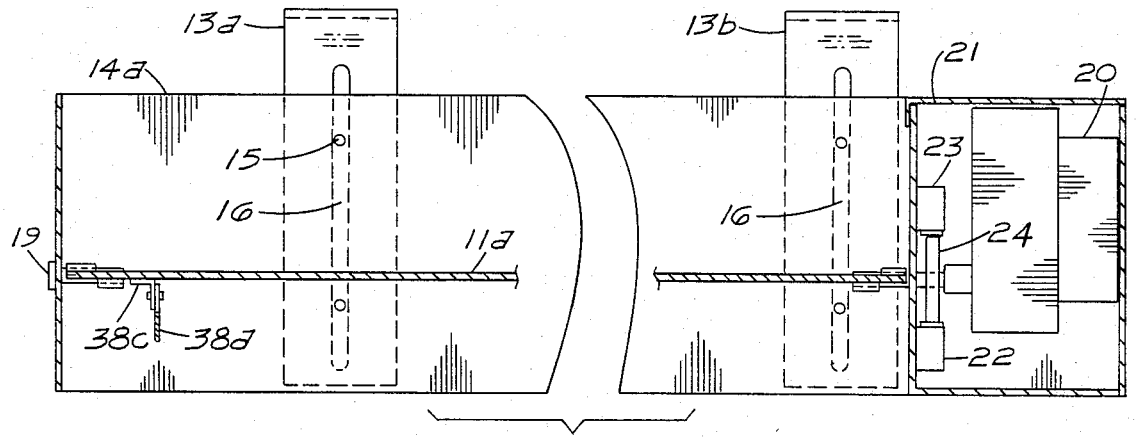
FIG. 2 is a longitudinal view taken along 2—2 of FIG. 1.
Figure 3:
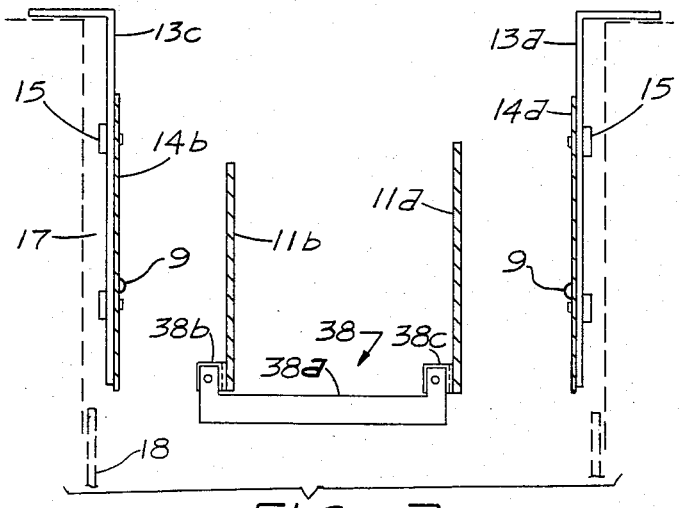
FIG. 3 is a cross-sectional view taken along line 3—3 of FIG. 1.
Figure 4:
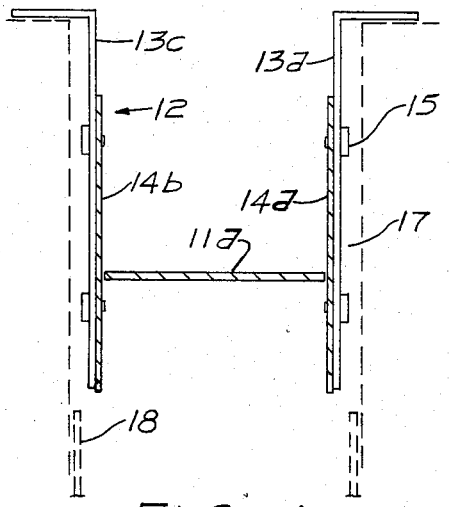
FIG. 4 is a cross-sectional view similar to FIG. 3, but showing a member damper means requiring only a singular damper blade.

Aforesaid damper blades 11*a* and 11*b* are rotably mounted in housing 12 by means of bearing pins 19 and shaft 20*a* of motor 20; said pins and shaft having connection to the blades as shown in FIGS. 1 and 2. Motor 20 being fully supported on end panel 14*c* of damper housing 12 passes its shaft through a hole in motor cover 21 to capture damper blade 11*a*. Aforesaid bearing pins likewise extend through holes in panels 14*c* and 14*d* to rotatably support the ends of blades 11*a* and 11*b*.

As shown in FIGS. 2 and 5 motor cover 21 cooperates to support the two way motor operating switch 22 and hold-in switch 23, both switches being operated by cam 24 attached to motor shaft 20*a*—the purpose of said switches to be explained.

To better understand the operation of the damper means, let's refer to FIG. 7. When a room or zone calls for heat, switch lever 25*a* of thermostatic means 25 closes thermostatic contacts 25*b*, 25*c*, and 25*d* thereby energizing fuel control device 26 (gas valve) through conductor 28, light means 29, and conductor 30; said light means providing an affirmation that thermostatic means 25 is in an operating mode. As the fuel control device urges the central heating/cooling appliance to enter a combustion cycle, motor winding 20*b* is simultaneously energized through switch lever 25*a*, a first position of motor switch 22, conductors 31 and 32, and relay contacts 33; said energizing of winding 20*b* causes motor to rotate damper blades 11 to an open position and influences cam 24 to move switch operator 22*a* to a second position to deenergize winding 20*b*. During the rotation of cam 24 through a 90 degree increment, hold-in switch 23 is locked in a closed position by cam 24, preventing premature deenergizing of winding 20*b* should thermostatic switch lever 25*a* be arbitrarily moved to open contacts 25*b*–25*d* while the damper blades are in a partially open position. Hold-in switch 23 maintains a closed circuit between thermostatic switch lever 25*a* and motor means until damper blades reach a position congruous with the operating state of the heating/cooling appliance.

Upon attaining the temperature required by the thermostatic means, the room environment influences thermostatic switch 25*a* to move to position 25*b*–25*e* energizing winding 20*c* through said second position of motor switch 22. The change of position of switch 25*a* causes thermostatic means 25 to relinquish control over fuel control device 26, and motor shaft 20*a* simultaneously rotates in the reverse direction from that previ-